US009656796B1

(12) United States Patent
Cammarata

(10) Patent No.: US 9,656,796 B1
(45) Date of Patent: May 23, 2017

(54) PILL DISPENSING BOTTLE SYSTEM

(71) Applicant: Michael Carl Cammarata, Largo, FL (US)

(72) Inventor: Michael Carl Cammarata, Largo, FL (US)

( * ) Notice: Subject to any disclaimer, the term of this patent is extended or adjusted under 35 U.S.C. 154(b) by 0 days.

(21) Appl. No.: 14/643,363

(22) Filed: Mar. 10, 2015

Related U.S. Application Data

(60) Provisional application No. 61/953,979, filed on Mar. 17, 2014.

(51) Int. Cl.

| | |
|---|---|
| ***G07F 11/16*** | (2006.01) |
| ***B65G 59/00*** | (2006.01) |
| ***B65H 3/00*** | (2006.01) |
| ***B65D 83/04*** | (2006.01) |

(52) U.S. Cl.
CPC ..... *B65D 83/0427* (2013.01)

(58) Field of Classification Search
CPC ..... B65D 83/427
USPC ..... 221/233, 95, 252, 265, 4, 288; 206/539, 206/457, 534; 222/142.9, 153, 480
See application file for complete search history.

(56) References Cited

U.S. PATENT DOCUMENTS 3,004,566 A * 10/1961 Raimo ..... B65D 83/049 141/18
3,027,000 A * 3/1962 Kantrow ..... B65D 83/0409 206/536
3,289,885 A * 12/1966 Villaveces ..... B65D 47/265 215/380
4,288,006 A * 9/1981 Clover, Jr. ..... B65D 47/265 206/534
4,308,979 A * 1/1982 Otterson ..... B65D 47/265 220/253
4,377,236 A * 3/1983 Montgomery ..... B65D 50/06 206/534
4,460,106 A * 7/1984 Moulding, Jr. .... B65D 83/0409 221/1
4,500,016 A * 2/1985 Funfstuck ..... B65D 47/265 222/153.14
4,530,447 A * 7/1985 Greenspan ..... B65D 83/04 221/288
4,541,541 A * 9/1985 Hickman ..... B65D 47/265 220/253
4,567,995 A * 2/1986 Kreiseder ..... B65D 47/265 220/253
4,611,725 A * 9/1986 Kacalieff ..... B65D 47/265 220/253
5,176,277 A * 1/1993 Schuermann ..... B65D 47/265 220/253
5,193,704 A * 3/1993 Kick ..... B65D 47/265 220/253
RE34,263 E * 5/1993 vanKerkhoven .... B65D 47/265 220/253
5,269,432 A * 12/1993 Beckertgis ..... B65D 47/265 215/250
5,383,582 A * 1/1995 Baxter ..... B65D 47/265 222/480

(Continued)

*Primary Examiner* — Rakesh Kumar

(57) ABSTRACT

A container has a bottom, a top, a lower section, an upper section, and a central axis. The upper section has a configuration with an interior surface and an exterior surface and with a central axis. A divider plate has a periphery in a configuration with a cutout. The periphery of the divider plate is coupled to the upper section.

1 Claim, 4 Drawing Sheets

(56) References Cited

U.S. PATENT DOCUMENTS

| | | | | | |
|---|---|---|---|---|---|
| 5,407,107 | A * | 4/1995 | Smith | B65D 47/265 | 222/548 |
| 5,421,472 | A * | 6/1995 | Beckertgis | B65D 47/265 | 220/253 |
| 5,542,579 | A * | 8/1996 | Robbins, III | B65D 41/26 | 222/158 |
| 5,549,217 | A * | 8/1996 | Benarrouch | B65D 83/0409 | 221/155 |
| 5,850,919 | A * | 12/1998 | Freed | B65D 51/28 | 206/534 |
| 6,142,337 | A * | 11/2000 | Schreckenberg | A61J 1/03 | 221/263 |
| 6,283,339 | B1 * | 9/2001 | Morrow | G01F 23/24 | 222/142.9 |
| 7,240,795 | B2 * | 7/2007 | Lee | B65D 83/0481 | 206/457 |
| 7,377,401 | B2 * | 5/2008 | Humphrey | G07F 11/44 | 221/133 |
| 7,735,684 | B2 * | 6/2010 | Coe | B65D 83/0409 | 221/25 |
| 7,909,212 | B2 * | 3/2011 | Parve | B65D 47/0847 | 222/480 |
| 7,967,160 | B2 * | 6/2011 | Rault | B65D 51/20 | 215/255 |
| 8,757,382 | B1 * | 6/2014 | Crawford | B65D 83/0481 | 206/534.2 |
| 2008/0251531 | A1 * | 10/2008 | Coe | B65D 83/0454 | 221/265 |
| 2014/0257185 | A1 * | 9/2014 | Bechmann | A61M 5/2033 | 604/135 |

* cited by examiner

PILL DISPENSING BOTTLE SYSTEM

BACKGROUND OF THE INVENTION

Related Application

The present application is based upon Provisional Application No. 61/953,979 filed Mar. 17, 2014, the subject matter of which is incorporated herein by reference.

Field of the Invention

The present invention relates to a pill dispensing bottle system and more particularly pertains to receiving and retaining a plurality of pills and for dispensing a limited number of pills in a safe and sanitary manner.

Description of the Prior Art

The use of pill bottles is known in the prior art. More specifically, pill bottles previously devised and utilized for the purpose of receiving and retaining and dispensing pills are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the prior art does not describe a pill dispensing bottle system that allows the receiving and retaining a plurality of pills and for dispensing a limited number of pills in a safe and sanitary manner.

In this respect, the pill dispensing bottle system according to the present invention substantially departs from the conventional concepts and designs of the prior art, and in doing so provides an apparatus primarily developed for the purpose of receiving and retaining and dispensing pills.

Therefore, it can be appreciated that there exists a continuing need for a new and improved pill dispensing bottle system which can be used for receiving and retaining a plurality of pills and for dispensing a limited number of pills in a safe and sanitary manner. In this regard, the present invention substantially fulfills this need.

SUMMARY OF THE INVENTION

In view of the disadvantages inherent in the known types of pill bottles now present in the prior art, the present invention provides an improved pill dispensing bottle system. As such, the general purpose of the present invention, which will be described subsequently in greater detail, is to provide a new and improved pill dispensing bottle system and method which has all the advantages of the prior art and none of the disadvantages.

To attain this, the present invention essentially comprises a pill dispensing bottle system. Such system includes a bottle having a closed bottom, an open top, a lower section, an upper section, and a central axis. The upper section has a cylindrical configuration with an interior surface and an exterior surface and with a central axis. A lid has a closed circular top and a cylindrical bottom couplable to the upper section of the bottle. The lid has an axis co-extensive with the central axis of the bottle. A divider plate has a periphery in a generally circular configuration with a cutout. The periphery of the divider plate is coupled to the upper section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The primary object of the present invention is to distribute pills in a safe and sanitary manner so as to aid in the reducing of the spread of viruses and bacteria as may occur with the handling of pills in a bottle system that also greatly reduces the amount of pills that can be accidently spilled out from the container.

It is also an object of the present invention to provide a new and improved pill dispensing bottle system which has all of the advantages of the prior art pill bottles and none of the disadvantages.

It is another object of the present invention to provide a new and improved pill dispensing bottle system which may be easily and efficiently manufactured and marketed.

It is further object of the present invention to provide a new and improved pill dispensing bottle system which is of durable and reliable constructions.

An even further object of the present invention is to provide a new and improved pill dispensing bottle system which is susceptible of a low cost of manufacture with regard to both materials and labor, and which accordingly is then susceptible of low prices of sale, thereby making such pill dispensing bottle system economically available.

Even still another object of the present invention is to provide a pill dispensing bottle system for receiving and retaining a plurality of pills and for dispensing a limited number of pills in a safe and sanitary manner.

Lastly, it is an object of the present invention to provide a new and improved system including a bottle which has a bottom, a top, a lower section, an upper section, and a central axis. The upper section has a configuration with an interior surface and an exterior surface and with a central axis. A divider plate has a periphery in a configuration with a cutout. The periphery of the divider plate is coupled to the upper section.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
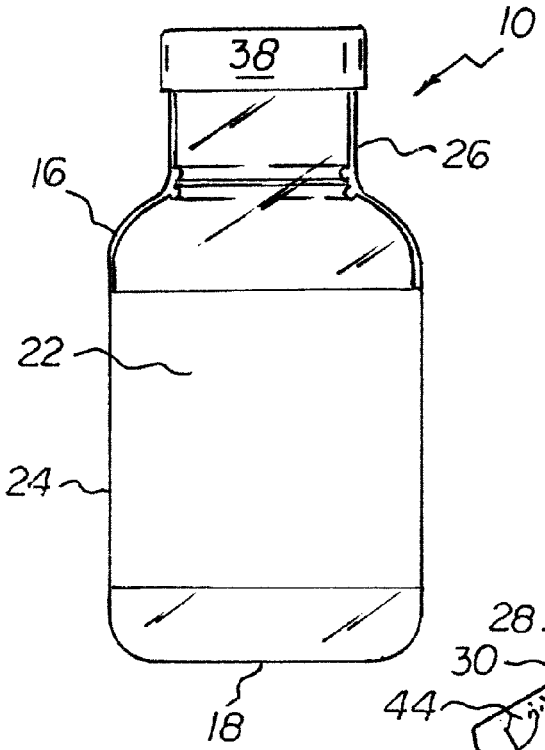
FIG. 1 is a front elevational view of a pill dispensing bottle system constructed in accordance with the principles of the present invention.

With reference now to the drawings, and in particular to FIG. 1 thereof, the preferred embodiment of the new and improved pill dispensing bottle system embodying the principles and concepts of the present invention and generally designated by the reference numeral 10 will be described.

The present invention, the pill dispensing bottle system 10 is comprised of a plurality of components. Such components in their broadest context include a bottle and a lid and a divider plate.

In the preferred embodiment, the invention a system designated by reference numeral 10. The pill dispensing bottle system 10 of the present invention is for receiving and retaining a plurality of pills 12 and for dispensing a limited number of pills in a safe and sanitary manner. Any type of pill is adapted to be received, retained and dispensed. The receiving, retaining, and dispensing being done in a safe, sanitary, reliable, convenient, and economical manner.

Figure 2A:
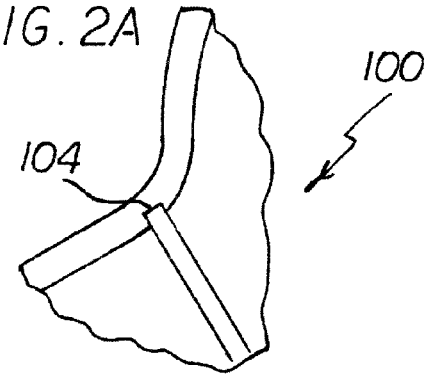
FIG. 2A is an enlarged illustration of the recess of the preferred embodiment of the invention.

First provided is a bottle 16 of any size, shape, color or translucency. The bottle has a closed bottom 18, an open top 20, and a peripheral side wall 22. The bottle has a lower section 24 of an enlarged size with upper and lower ends. The lower section receives and supports the plurality of pills 12. The bottle has an upper section 26 of a reduced size with upper and lower ends. The lower end of the upper section is integrally formed with the upper end of the lower section. The upper section is in a cylindrical configuration with an interior surface 28 and an exterior surface 30. The exterior surface of the upper section is formed with screw threads 32. An annular shoulder 34 with a ledge is formed on the interior surface of the upper section. The bottle has a central axis. As seen in FIG. 2A, the container 100 has a recess 104, rather than a shoulder, which has become a preferred mode in most applications.

The bottle preferably is in the shape of a right circular cylinder. Other configurations such as a rectangular cross section or a conical cross section are also envisioned.

Next provided is a lid 38. The lid has a top 40 and a bottom 42. The cylindrical bottom has internal screw threads 44 threadedly couplable to the screw threads of the upper section of the bottle. The lid has an axis co-extensive with the axis of the bottle.

A divider plate 48 is next provided. The divider plate can be in various sizes or shapes to accommodate the various bottles. It is fabricated of any type of material including plastic, metal and the like. Most bottles are of a size to accommodate divider plates of from 1.00 to 1.50 inches. The divider plate has a periphery 50 in a generally circular configuration with a diameter of 1.25 inches, but can vary. The divider plate has a cutout 52 in a bi-convex configuration, but not limited to bi-convex shape. This cutout is optimally for between 65 degrees and 140 degrees, but can vary. The periphery of the divider plate can be removable. In the preferred embodiment it is removably coupled to the upper section by the ledge of the recess in the upper section of the bottle.

Figure 2:
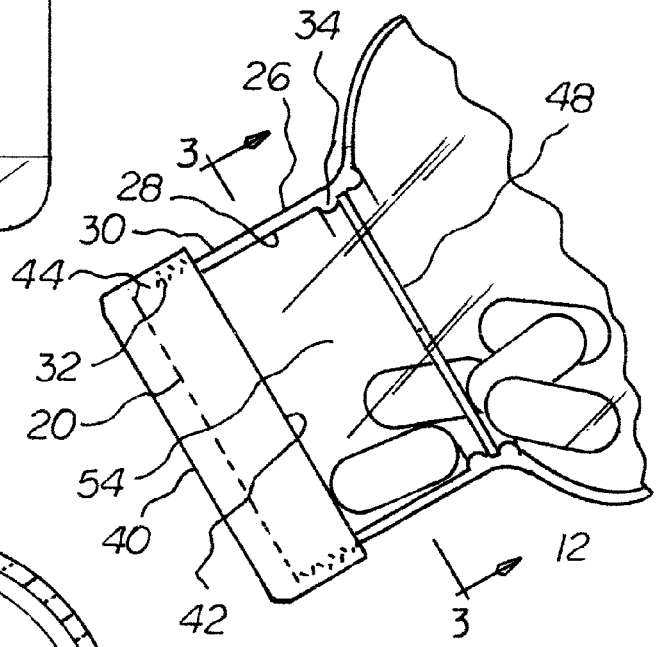
FIG. 2 is a side elevational view of the upper extent of the pill dispensing bottle system shown in FIG. 1, the system being in a tipped dispensing orientation.
Figure 3:
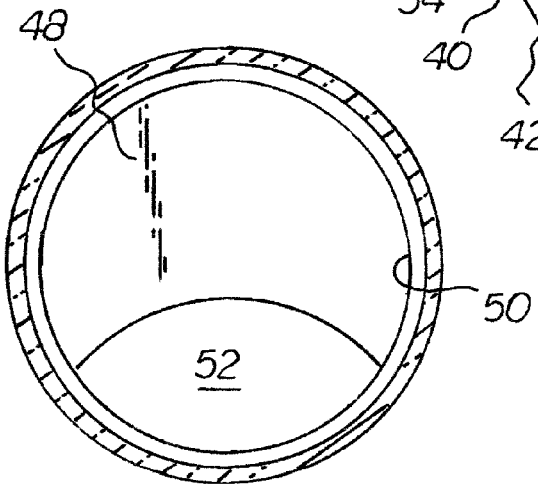
FIG. 3 is a cross sectional view taken along line 3-3 of FIG. 2.
Figure 4:
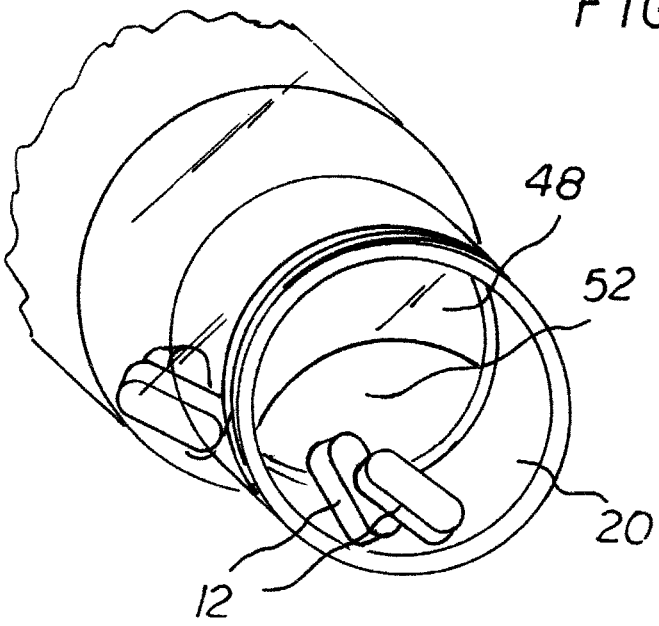
FIG. 4 is a perspective illustration of the system tipped and rotated to a dispensing orientation.
Figure 5:
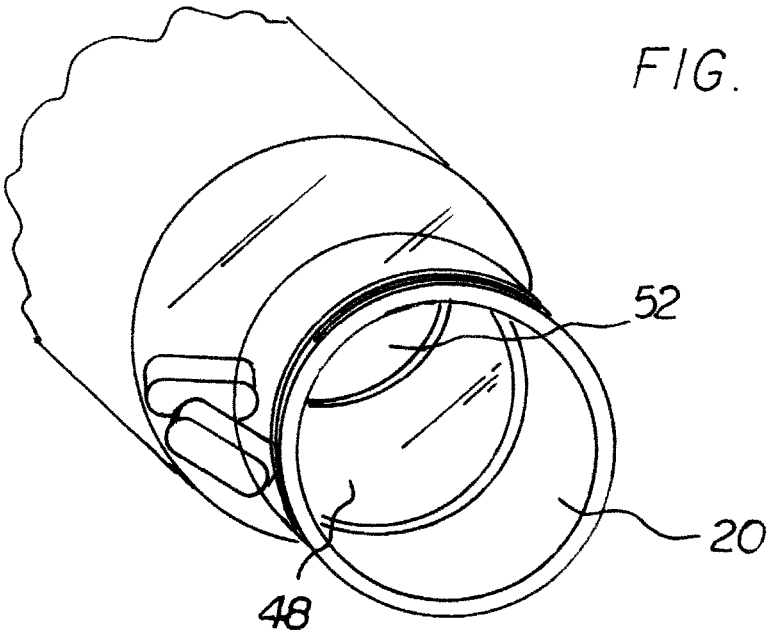
FIG. 5 is a perspective illustration similar to FIG. 4 but with the bottle rotated to a non-dispensing orientation
Figure 6:
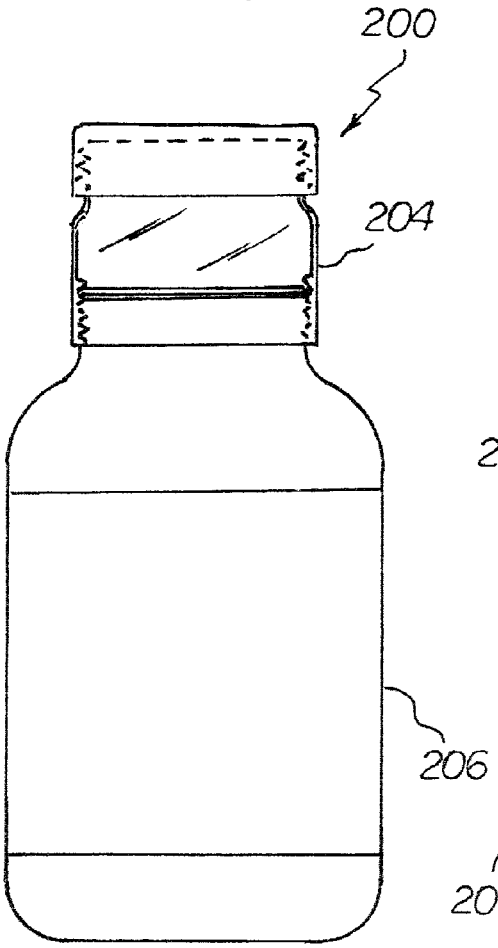
FIG. 6 is a front elevational view of an alternate embodiment of the invention.
Figure 7:
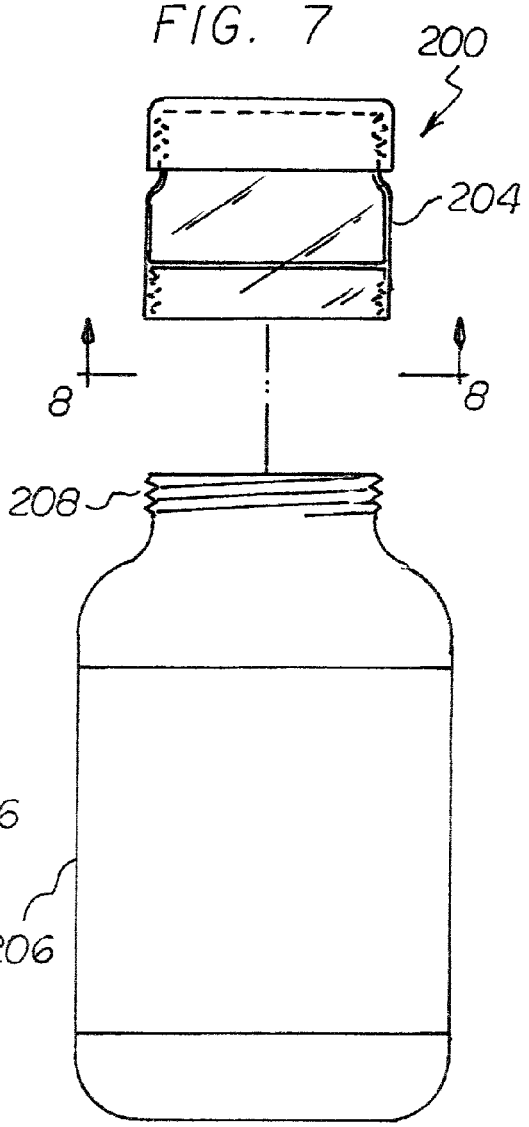
FIG. 7 is an exploded front elevational view of the system shown in FIG. 6.
Figure 8:
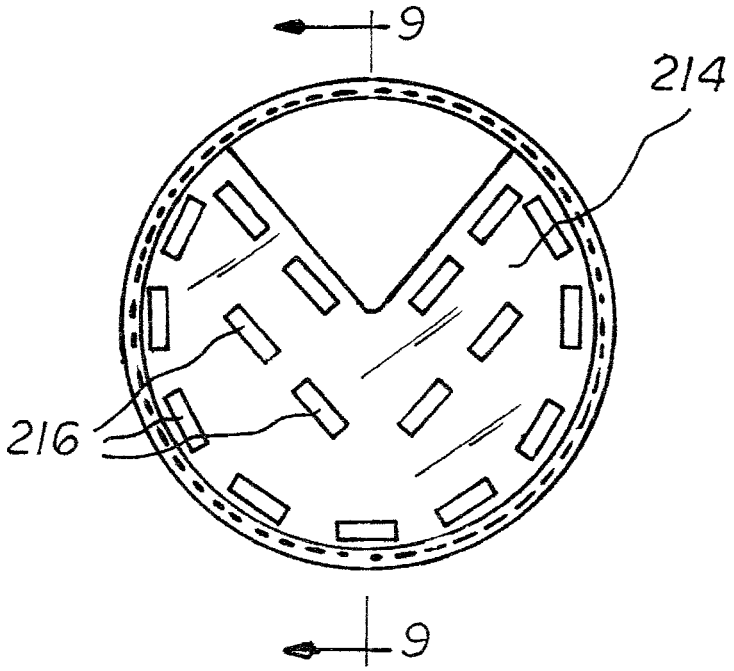
FIG. 8 is a bottom view of the alternate embodiment of the invention taken along line 8-8 of FIG. 7.
Figure 9:
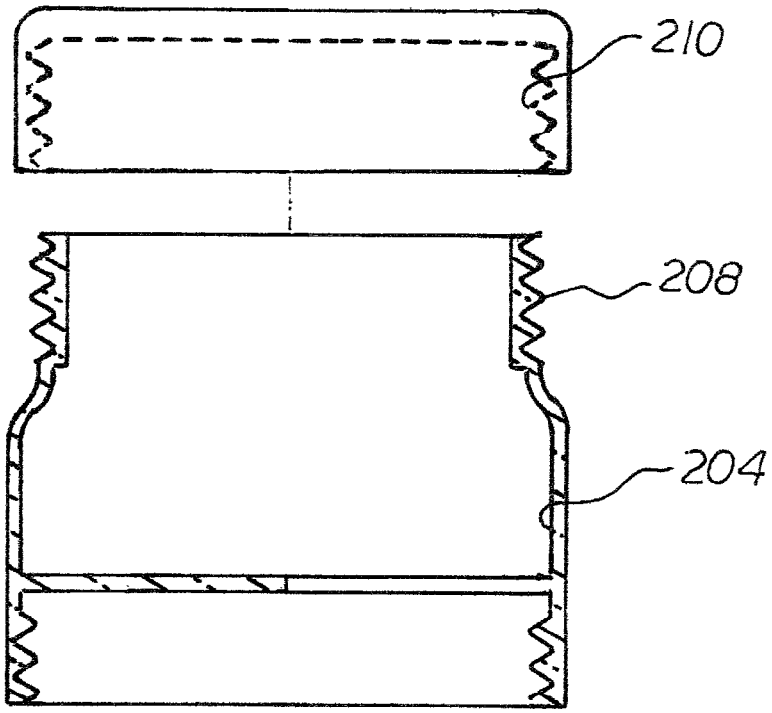
FIG. 9 is a cross sectional view taken along line 9-9 of FIG. 8.

A partially or completely translucent chamber 54 having a cylindrical configuration is formed in the upper section of the bottle between the open top and the divider plate. The chamber has a length between 40 percent and 60 percent of the diameter of the upper section. The bottle is adapted to be tipped with the axis at between 40 degrees and 60 degrees with respect to horizontal with the lower section above the upper section whereby the desired number of pills, two pills in the preferred embodiment, are moved from the lower section of the bottle into the chamber for consumption by a user when the cutout within the divider plate is below the axis. Note FIGS. 2 and 4. In this manner, movement of pills into the chamber is abated when the bottle is rotated and the cutout within the divider plate is above the axis. Note FIG. 5.

In the preferred embodiment of the invention, the system 100 further includes an indentation 104 with a U-shaped recess formed in the interior surface of the upper section. The U-shaped recess receives the periphery of the divider plate. Note FIG. 2A.

In another alternate embodiment of the system 200, the upper section 204 and the lower section 206 are separately fabricated. Screw threads 208, 210 separably couple the upper section and the lower section during use. The divider plate 214 remote from the cutout 216 is formed with a plurality of apertures 218.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pill dispensing bottle system (10) comprising, in combination:

a bottle (16) having a closed bottom (18), an open top (20), and a peripheral side wall (22), the bottle having a lower section (24) of an enlarged size with upper and lower ends, the lower section receiving and supporting a plurality of pills (12), the bottle having an upper section (26) of a reduced size with upper and lower ends, the upper section having a predetermined diameter, the lower end of the upper section being integrally formed with the upper end of the lower section, the upper section being in a cylindrical configuration with an interior surface (28) and an exterior surface (30), the exterior surface of the upper section being formed with screw threads (32), an annular recess (34) creating a ledge formed on the interior surface of the upper section adjacent the lower section, the bottle having a central axis, the annular recess being bounded above by an upper annular projection extending into the upper section, the upper annular projection having a semi-circular cross sectional configuration, the annular recess being bounded below by a lower annular projection extending into the lower section, the lower annular projection having a semi-circular cross sectional configuration;

a lid (38) having a closed circular flat top (40) and a cylindrical bottom (42), the cylindrical bottom having internal screw threads (44) threadedly coupled to the screw threads of the upper section of the bottle, the lid having an axis co-extensive with the central axis of the bottle; and a single divider plate (48) having a flat upper surface and a flat lower surface and having a periphery (50) in a generally circular configuration with a diameter of from 1.00 to 1.50 inches, the divider plate having a single cutout (52) in a configuration, the cutout having a first section and a second section, the first section of the cutout being along the periphery for between 65 degrees and 140 degrees of the periphery of the divider plate, the second section of the cutout extending from the first section of the cutout towards the axis of the bottle, the periphery of the divider plate being coupled to the upper section by the ledge of the annular shoulder, a chamber (54) having a cylindrical configuration formed in the upper section of the bottle between the circular flat top of the lid and the flat divider plate, the chamber having a length between 40 percent and 60 percent of the diameter of the upper section, the bottle adapted to be tipped with the axis at between 40 degrees and 60 degrees with respect to horizontal with the lower section above the upper section whereby two pills are moved from the lower section of the bottle into the chamber for consumption by a user when the cutout is below the axis, whereby movement of pills into the chamber is abated when the bottle is rotated and the cutout is above the axis.

* * * * *